US008905873B2

(12) United States Patent
Lowden

(10) Patent No.: US 8,905,873 B2
(45) Date of Patent: Dec. 9, 2014

(54) HOCKEY STICK SHAFT PROTECTOR

(71) Applicant: Stephen Robert Lowden, Bradford (CA)

(72) Inventor: Stephen Robert Lowden, Bradford (CA)

( * ) Notice: Subject to any disclaimer, the term of this patent is extended or adjusted under 35 U.S.C. 154(b) by 72 days.

(21) Appl. No.: 13/694,400

(22) Filed: Nov. 29, 2012

(65) Prior Publication Data

US 2014/0066234 A1 Mar. 6, 2014

Related U.S. Application Data

(60) Provisional application No. 61/565,409, filed on Nov. 30, 2011.

(51) Int. Cl.

| | |
|---|---|
| ***A63B 59/14*** | (2006.01) |
| ***A63B 59/00*** | (2006.01) |
| *A63B 71/00* | (2006.01) |

(52) U.S. Cl.

CPC ..... *A63B 59/0092* (2013.01); *A63B 2209/10* (2013.01); *A63B 2071/0063* (2013.01); *A63B 2209/00* (2013.01); *A63B 59/14* (2013.01); *A63B 59/0088* (2013.01)

USPC ..... 473/560

(58) Field of Classification Search

USPC ..... 473/560–563

See application file for complete search history.

(56) References Cited

U.S. PATENT DOCUMENTS

| | | | | |
|---|---|---|---|---|
| 1,687,736 | A * | 10/1928 | Root | 473/560 |
| 6,500,079 | B1 * | 12/2002 | Tucker, Sr. | 473/513 |
| 8,241,154 | B2 * | 8/2012 | Pfeifer | 473/560 |
| 2001/0018378 | A1 * | 8/2001 | Burger | 473/561 |
| 2002/0094891 | A1 * | 7/2002 | Horwood et al. | 473/560 |
| 2006/0122013 | A1 * | 6/2006 | Dodge et al. | 473/516 |
| 2010/0323830 | A1 * | 12/2010 | Blotteaux et al. | 473/563 |
| 2011/0160009 | A1 * | 6/2011 | Le | 473/563 |
| 2012/0149505 | A1 * | 6/2012 | Phillips | 473/560 |

* cited by examiner

*Primary Examiner* — Mark Graham

(57) ABSTRACT

A protective strip device to apply to the shaft of a hockey stick, the strip device having an inner side face, adhesive on the inner side face for bonding to the shaft of the stick, an outer facing side defining a central groove, and two spaced apart shock absorbing side abutment ridges extending lengthwise along opposite sides of the central groove, and a plurality of spaced apart openings formed along the central groove.

3 Claims, 4 Drawing Sheets

HOCKEY STICK SHAFT PROTECTOR

FIELD OF THE INVENTION

This application claims priority of the filing date of U.S. Provisional application Ser. No. 61/565,409 which was filed Nov. 30, 2011.

The invention relates to a Hockey Stick Shaft Protector strip for use on the shaft of a hockey stick, to protect it from damage during play.

BACKGROUND OF THE INVENTION

It is well known that a hockey stick, for playing ice hockey, is frequently damaged by being struck by the stick of another player. The area most susceptible to damage is the front edge of the shaft. When it becomes chipped or worn, the stick will be broken much more easily.

Attempts to strengthen this shaft area are faced with the requirement that the stick shall be as light as is practical, for ease of handling, and also that the stick shall be balanced in the hands.

Clearly it would be possible to simply make the shaft thicker, but this would make the stick heavier and alter the balance of the stick. It would also mean changing the entire design of the stick. Manufacturers would have to re-tool.

It is therefore desirable to provide some form of added protection which can be applied to standard hockey sticks, without altering their construction.

Sticks and in other sports such as Lacrosse are also subject to damage.

The present invention is directed to providing a solution to these conflicting problems in a novel and economical manner.

BRIEF SUMMARY OF THE INVENTION

The present invention provides a protective strip device to apply to the shaft of a hockey stick, the strip device comprising an inner side face, adhesive on the inner side face for bonding to the shaft of the stick, an outer facing side defining a central groove, and two spaced apart shock absorbing side abutment ridges extending lengthwise along opposite sides of said central groove, and a plurality of spaced apart openings formed along said central groove.

Preferably the device is formed from resilient material selected from rubber, neoprene, and thermoplastic.

Preferably the device defines side flange portions on either side of said inner side face, said side flange portions being shaped to fit partly around the side edges of said shaft.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

DETAILED DESCRIPTION OF THE INVENTION

Figure 1:
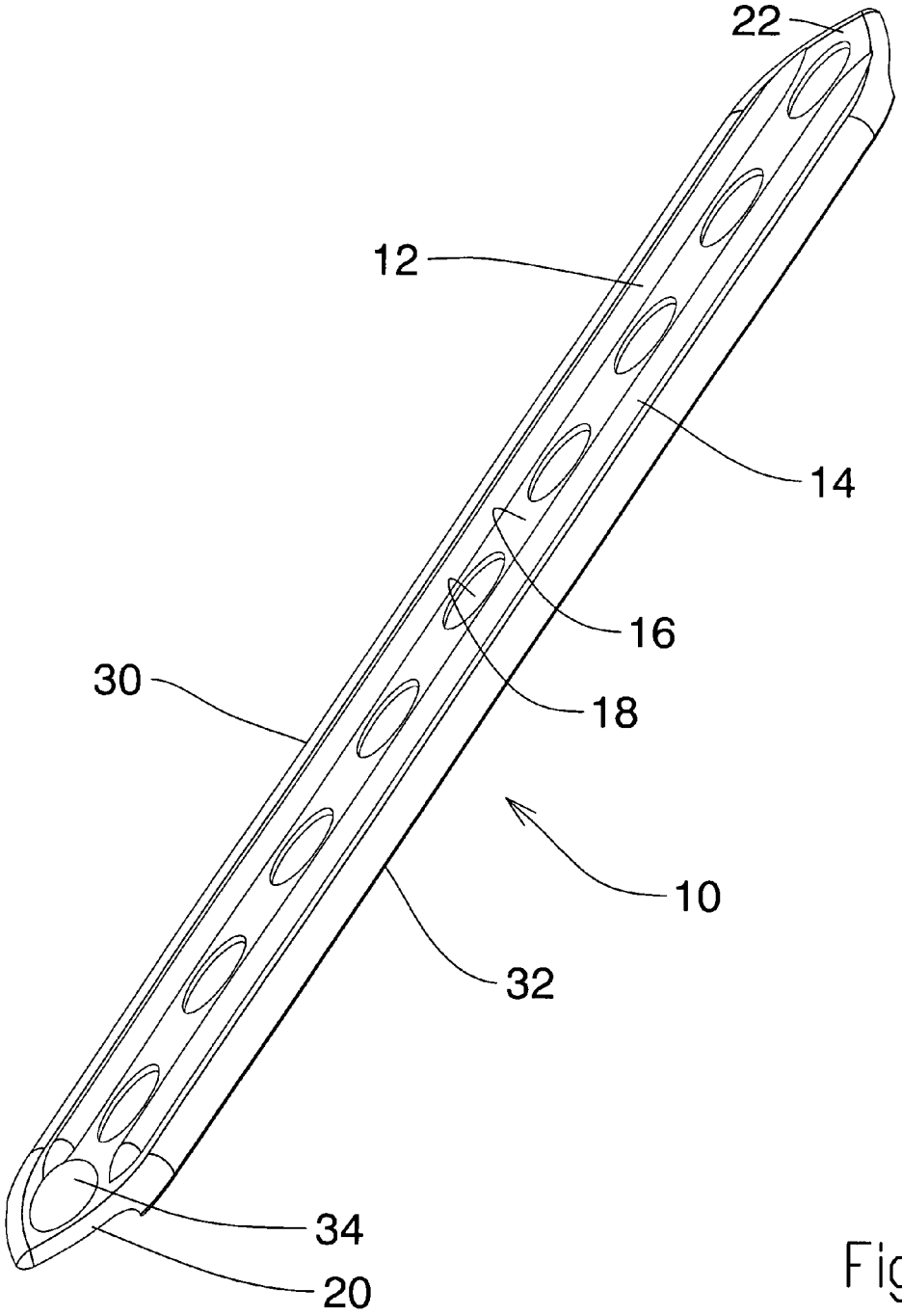
FIG. 1 is a perspective view of a protective strip device of the present invention.
Figure 2:
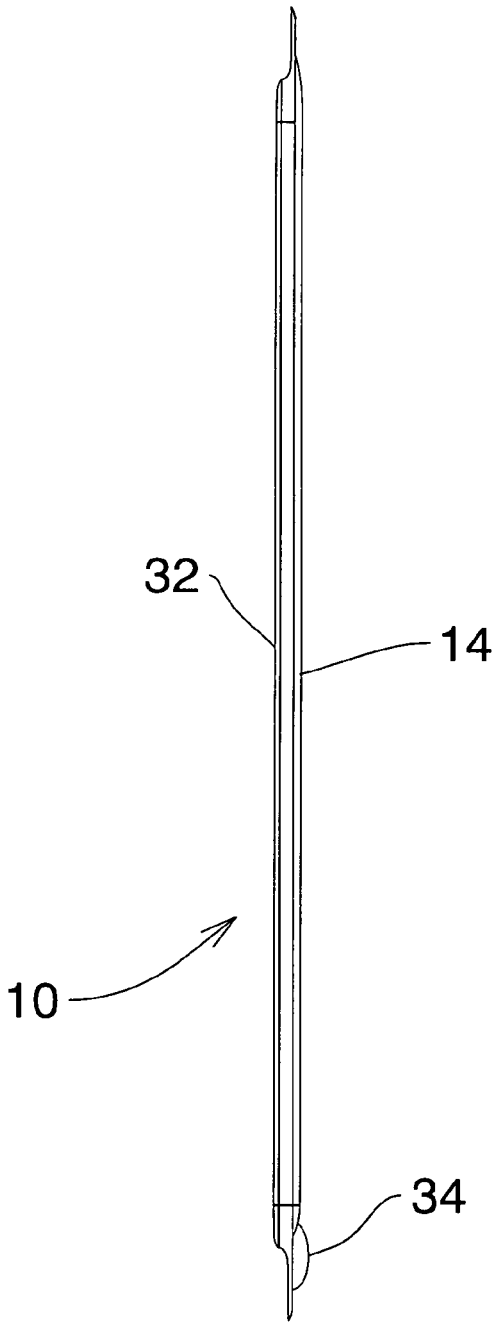
FIG. 2 is a side view of a protective strip device of FIG. 1.
Figure 3:
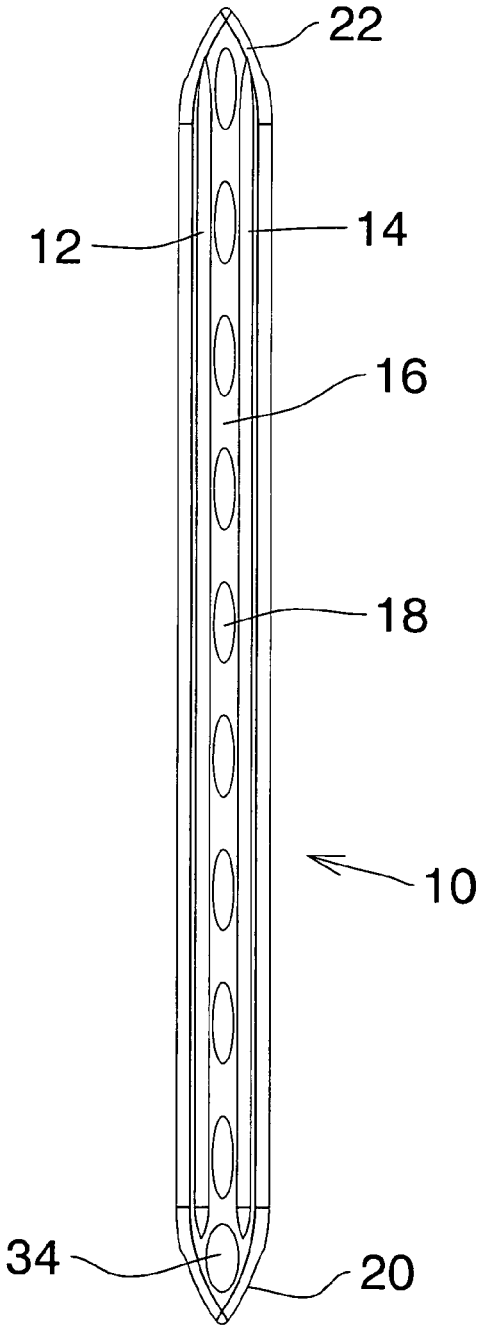
FIG. 3 is a top view of a protective strip device of FIG. 1.
Figure 5:
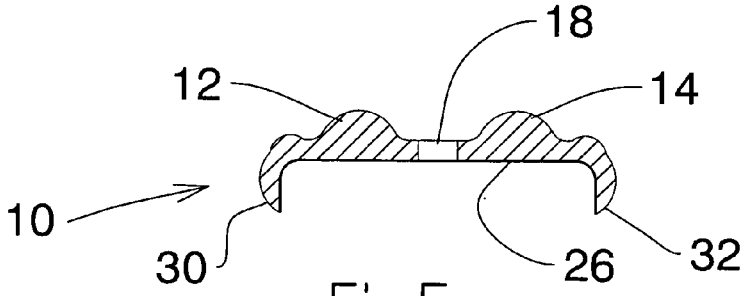
FIG. 5 is a cross sectional end view of a protective strip device of FIG. 1; and, FIG. 6 is a schematic exploded perspective showing a stick and the strip.
Figure 4:
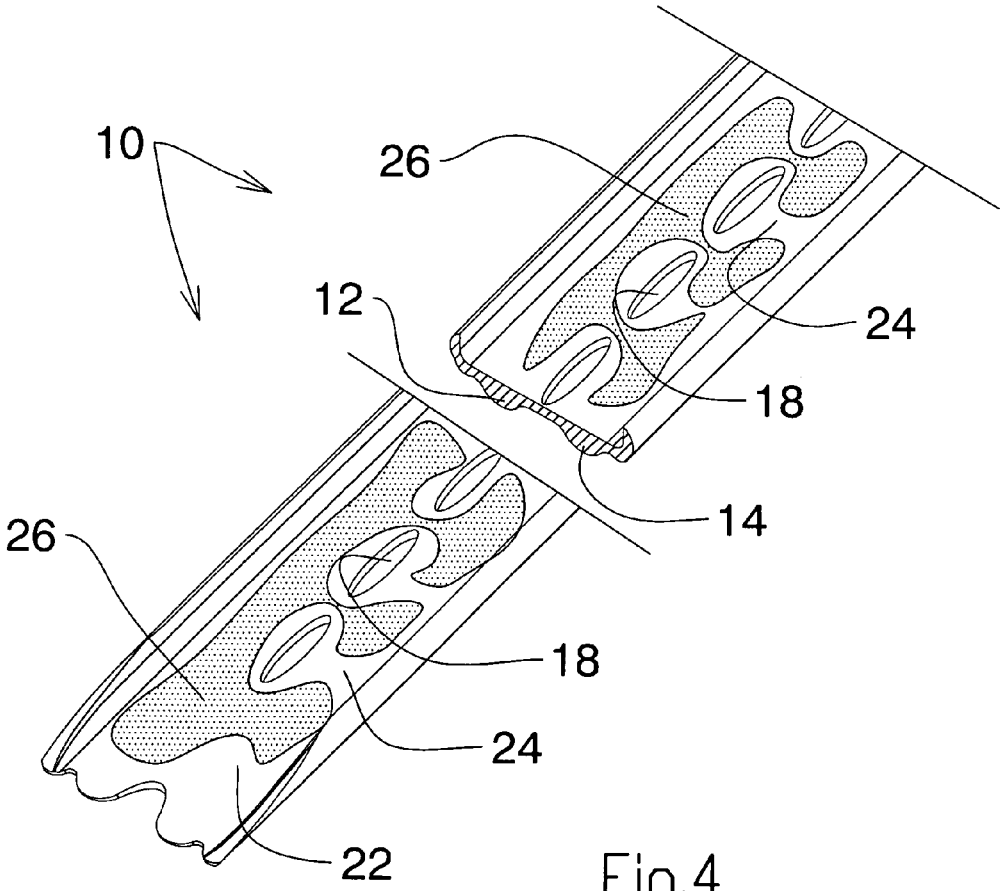
FIG. 4 is a reverse perspective view of a protective strip device of FIG. 1.

Referring now to the invention in more detail, in FIG. 1 to FIG. 5, there is shown a long, low profile bumper device (10). The invention is described as applied to the shaft of a hockey stick, however it is equally applicable to sticks used in sports such as Lacrosse. Raised ridges extend along the long sides namely a left edge ridge (12), and a right edge ridge (14). A low central reduced thickness portion (16) extends down the center between each raised edge ridge. The center portion preferably has holes (18) knocked out of the material, but in some cases it can just be a very thin layer of the material. The central portion defines a first thickness, and the side ribs define a second thickness greater than the first thickness. The lower end (20) and upper end (22) of the bumper are tapered towards the shaft surface on which they will be adhered.

The bumper device (10) is tapered towards the lower end (20). The inside surface (24) of the bumper (10) is flat and has an adhesive coating (26) covered by a removable cover strip (not shown).

The side flanges (30) and (32) extend downwards from the inside surface to slightly wrap around the top edge of a standard composite hockey stick. The coating (26) extends around the inside of side flanges (30) and (32). The raised edge ridges (12) and (14) become thinner as they rise away from the base.

There is an abutment (34) at the lower end (20) of the bumper (10) which provides extra protection if others' sticks slide down the protected stick towards the blade.

Figure 6:
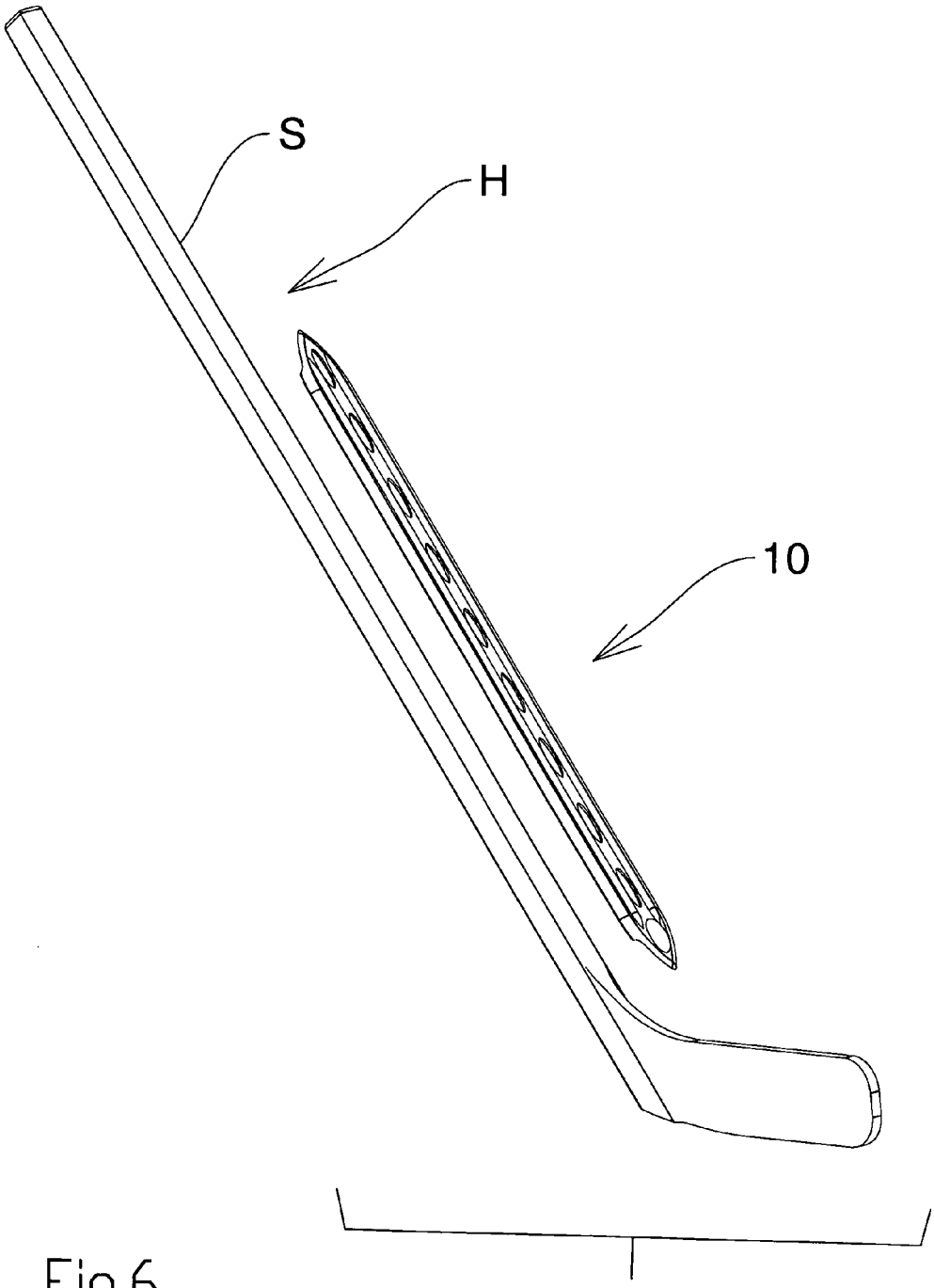

FIG. 6 shows a typical hockey stick (h) having a shaft (s). The bumper device is shown exploded, prior to attachment to the front edge of the shaft.

The invention of FIG. 1 to FIG. 5, will absorb and/or disperse the force from continual impact from other hockey sticks and pucks, as delivered along the two raised side edges of the bumper device. Beginning at the youth level, right through to the professional level, this force is regularly, and aggressively delivered from above—or the side—by other hockey players (typically adult or strong youth players) causing a great number of broken sticks—usually on the receiving end. As such, the bumper (10) will dramatically reduce the incidence of instant breakage, as well as future stick breakage due to the compromising of the stick's core material. This protection will help players reduce their usage rate of expensive hockey sticks, for a relatively small cost, and with negligible diminished performance.

In further detail, still referring to the invention of FIG. 1 to FIG. 5, is that the bumper (10) be approximately 18" in length, 1" in width, and 0.25" in depth in order to fit a standard composite hockey stick, while having a fairly low profile around which a hockey glove can grasp easily.

The height of the raised edge ribs (12) and (14) will be enough (approx 0.2") to absorb and/or disperse the force from the impact from other hockey sticks and/or pucks.

The tapering of the upper end (22) of the bumper will allow the hand/glove to slide down the stick with ease and minimal obstruction.

The construction details of the invention as shown in FIG. 1 to FIG. 5 are that the bumper (10) may be made of hi-density rubber, namely EPDM (Ethylene Propylene Diene Monomer) rubber, or of any other similar—and sufficiently strong and protective rubber-like material, that can absorb and/or disperse the force of continual impact from other hockey sticks and pucks, as delivered by other players—typically adult or strong youth players.

The adhesive (26) would be one that can securely attach the rubber bumper (10) to a laminated composite or fibreglass hockey stick, after removal of a wax paper strip (28) or other similar method, as deemed appropriate. An adhesive, similar to that found in rodent "glue traps" would be used.

The rubber material used for the bumper (10) would be one that could be factory-painted to accommodate colour, designs, and other customized visual applications such as names, logos or branding. The advantages of the present invention include, without limitation, that it is a simple attachment. Being simple, it will require virtually no product education or explanation. Further, it is affordable to manufacture, and could therefore sell for a reasonable price compared to the item it protects. As "stick insurance", its sales pitch is a relatively straightforward one. Further, it is made from material that cannot break, shift, freeze, melt—nor harm the user—under any normal, foreseeable conditions. It is also light enough that performance should not be diminished at all, except perhaps at the most elite Professional level. Further it reduces "ice-rage" caused by having a new stick instantly broken after just a couple of games.

Essentially it prolongs the life of the investment (a new expensive composite stick), thereby helping to reduce annual stick budgets, which typically run from $150 to $700 or more, at the adult recreational level. Breakage occurs due to "slashing" a large percentage of the time, and composite sticks are expensive (typically $70-$300), so protection will make sense to the average, non-professional user, regardless of their wealth.

In broad embodiment, the present invention is a protective device for users to apply to the shaft of a sports stick, for the purpose of reducing the force from other sticks ("slashing") as they impact it, thus reducing the incidence of breakage.

While the foregoing written description of the invention enables one of ordinary skill to make and use what is considered presently to be the best mode thereof, those of ordinary skill will understand and appreciate the existence of variations, combinations and equivalents of the specific embodiment, method, and examples herein. The invention should therefore not be limited by the above described embodiment, method, and examples, but by all embodiments and methods within the scope and spirit of the invention as claimed.

What is claimed is:

1. A homogenous one piece moulded front edge protector for a hockey stick shaft to protect the front edge of the shaft from damage during play, and comprising;

a front edge protective strip device shaped to conform to and apply to the front edge of the shaft of a stick, said strip device defining an upper and lower end, and having;

an inner side face;

adhesive on the inner side face for bonding to the front edge of the shaft of the stick;

an outer facing side defining a central thin portion of a first predetermined thickness;

two spaced apart shock absorbing side abutment ridges extending lengthwise along opposite sides of said central thin portion of a second predetermined thickness greater than said first thickness;

a plurality of spaced apart openings formed along said central thin portion:

a tapered portion on the upper end of said strip device; and, a tapered portion on the lower end of said strip device having a raised abutment on the lower end of said strip device, all formed as an integral one piece homogenous integral body.

2. The front edge protector for a hockey stick shaft of claim 1 wherein said strip is formed of hi-density rubber.

3. The front edge protector for a hockey stick shaft of claim 1 including side flange portions on either side of said inner side face, said side flange portions being shaped to fit partially around the side edges of said shaft.

* * * * *